US010125058B1

(12) United States Patent
Bellitto

(10) Patent No.: US 10,125,058 B1
(45) Date of Patent: Nov. 13, 2018

(54) ENCAPSULATED, PARTICULATE ENERGETIC COMPOSITION AND THE MAKING OF SAME

(75) Inventor: Victor J. Bellitto, Alexandria, VA (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 840 days.

(21) Appl. No.: 12/587,321

(22) Filed: Sep. 24, 2009

(51) Int. Cl.
*C06B 45/20* (2006.01)
*C06B 21/00* (2006.01)

(52) U.S. Cl.
CPC ..... *C06B 45/20* (2013.01); *C06B 21/00* (2013.01)

(58) Field of Classification Search
CPC ..... C06B 45/20; C06B 21/0091; C06B 25/04; C06B 21/00; C06B 45/00; C06B 45/30
USPC ..... 149/92
See application file for complete search history.

(56) References Cited

U.S. PATENT DOCUMENTS 3,522,334 A * 7/1970 Hunter et al. ..... 264/3.1
3,528,889 A * 9/1970 Portno ..... C12C 11/075 435/301.1
3,953,256 A * 4/1976 Schwarz et al. ..... 149/5
5,567,912 A * 10/1996 Manning et al. ..... 149/12
6,428,724 B1 * 8/2002 Lukasavage et al. ..... 264/3.4
7,807,000 B1 * 10/2010 Baker ..... C06B 33/08 149/1
2009/0044887 A1 * 2/2009 Adiga ..... C06B 21/0066 149/109.4

OTHER PUBLICATIONS

U.S. Appl. No. 11/300,134, filed Sep. 6, 2007, Bellitto et al.
Bellitto, Victor J., High Explosive and Metal Composites, 38th International Annual Conference of ICT, Jun. 26-29, 2007.
Melting points of the elements (data page), Wikipedia, Nov. 8, 2017.
Ammonium Perchlorate, Wikipedia, Jan. 30, 2018.
Cameo Chemicals, ammonium Perchlorate, Version 2.7 rev 2.
Ther Thermal Decomposition of Ammonium Perchlorate: A Literature Review, A.G. Kennan, et al, Aug. 1, 1968, Miami University Goral Gables, Miami, AD673 542.
RDX, Wikipedia, Feb. 17, 2018.

* cited by examiner

*Primary Examiner* — Aileen B Felton
(74) *Attorney, Agent, or Firm* — Fredric J. Zimmerman

(57) ABSTRACT

An encapsulated, particulate energetic composition includes one of explosive particles of a known size, oxidizer particles of a known size, and a mixture of explosive particles and oxidizer particles of known sizes, in which particles of one of the explosive particles, the oxidizer particles, and the mixture of the explosive and the oxidizer particles, are encapsulated by a combustible fuel of a known thickness to enhance the energy output. A method of making the encapsulated, particulate energetic composition includes placing one of explosive particles, oxidizer particles, and a mixture of explosive particles and oxidizer particles within a deposition chamber, mixing one of the explosive particles, the oxidizer particles, and the mixture of explosive particles and the oxidizer particles, and depositing, to a known encapsulating thickness, a combustible fuel onto the one of the explosive particles, the oxidizer particles, and the mixture of explosive particles and oxidizer.

9 Claims, 4 Drawing Sheets

XPS following Al sputter deposition

ENCAPSULATED, PARTICULATE ENERGETIC COMPOSITION AND THE MAKING OF SAME

STATEMENT OF GOVERNMENT INTERESTS

The invention described herein may be manufactured and used for the Government of the United States of America for governmental purposes without payment of any royalties thereon or therefore.

FIELD OF THE INVENTION

The present invention generally relates to an encapsulated, particulate energetic composition, in which explosive particles of a known size (distribution), oxidizer particles of a known size (distribution), or a mixture of explosive and oxidizer particles, in which the explosive particles and the oxidizer particles of the mixture are of known sizes (distribution), may be encapsulated by a combustible fuel, and the making of the encapsulated, particulate energetic composition. Specifically, explosive particles of a known size, oxidizer particles of a known size, or a mixture of explosive and oxidizer particles, in which the explosive particles and the oxidizer particles of the mixture are of known sizes, may be encapsulated with a combustible fuel to a known encapsulating thickness. More specifically, encapsulation to a known thickness may be accomplished by deposition of the combustible fuel onto the one of the explosive particles, the oxidizer particles, or the mixture of explosive and oxidizer particles.

BACKGROUND OF THE INVENTION

"Energetic" compositions are used in a wide variety of applications, e.g., explosives, propellants, initiating materials, and gas generators. Energetic compositions may reflect one or more characteristics of their particular application; that is, an energetic composition may be designated as, for example, an explosive in one application, or a propellant in another application. Conventional formulations of energetic compositions can include the following: binders, bonding agents, combustion catalysts, desensitizers, explosives, fuels, oxidizers, plasticizers, and wetting agents. Typically, conventional formulations of energetic compositions are mixed, cast, pressed, and sometimes dried.

One of the primary goals in developing new energetic compositions is to increase the energy output. Within the conventional formulation of an energetic composition, explosives, fuels, and oxidizers, are typically thought of as directly contributing to the energy output, while binders, bonding agents, desensitizers, plasticizers, and wetting agents are typically used to enhance manufacturability or to ensure that explosives, fuels and/or oxidizers maintain some degree of proximity to one another in the formulation. After mixing of the conventional formulation, an explosive particle or an oxidizer particle within the resultant mix can be located at a distance from a combustible fuel particle by, for example, intervening binder or plasticizer particles. This separation of the explosive particle or the oxidizer particle from the combustible fuel particle can decrease the energy output of the energetic composition, when compared to an energetic composition in which the explosive particle or the oxidizer particle is adjacent to the combustible fuel particle.

A U.S. patent application, entitled, "Energetic Composition of Adjacent Layers of an Explosive and a Combustible Fuel and Making of Same" and filed in the U.S. Patent Office on 6 Sep. 2007, discloses an energetic composition of adjacent layers of an explosive and a combustible fuel, such as, a combustible metal. Layers of the explosive are formed by vapor deposition upon a surface, and layers of the combustible metal, are formed by vapor deposition or physical deposition onto a surface of the explosive.

There remains a need to further enhance the energy output of an energetic composition, to more easily form different shapes and sizes of these shapes with the energetic composition, and to use readily available energetic materials in the making of the energetic composition.

SUMMARY OF THE INVENTION

An energetic composition may benefit greatly in increased energy output, if an explosive and/or an oxidizer may always be positioned adjacent to a combustible fuel. The enhanced proximity of the explosive and/or the oxidizer to the combustible fuel may result in more complete consumption of the combustible fuel, providing increased energy output. Such an increased energy output for an energetic composition may translate into significant weight reductions for the energetic composition when used, for example, as an explosive payload or as a propellant.

The enhanced proximity of the explosive particles and/or the oxidizer particles to an encapsulating combustible fuel in the encapsulated, particulate energetic composition of the invention may also provide a larger interfacial contact area between the explosive particles and/or the oxidizer particles to the encapsulating combustible fuel, which may result in a faster propagating combustion.

The enhanced proximity of the explosive particles and/or the oxidizer particles to the encapsulating combustible fuel may also provide performance improvements to encapsulated, particulate energetic compositions in such explosive characteristics as, plate dent tests, higher detonation velocity, and higher detonation pressure.

The enhanced proximity of the explosive particles and/or the oxidizer particles to the encapsulating combustible fuel in particulate, energetic compositions may also provide improvements in propellants, such as, higher burning rate, better combustion stability, and better combustion efficiency.

The enhanced proximity of the explosive particles and/or the oxidizer particles to the encapsulating combustible fuel may also increase the mass density of the encapsulated, particulate energetic composition, and may thus increase the energy density of the encapsulated, particulate energetic composition.

A solid rocket propellant can be a mixture of oxidizer, combustible fuel, binder, and other additives. It is well known, however, that some combustible fuels, for example, some metal and metal oxides, can also act as a combustion catalyst, which modifies the burning rate of the propellant. Ferric oxide and copper chromite are typical combustion catalysts currently used to modify the burning rate of conventional propellants. The enhanced proximity of the encapsulating combustible fuel, such as, ferric oxide or copper chromite, to the oxidizer particles may cause the combustible fuel to also act as a combustion catalyst, which may improve the efficiency of the combustion reaction, increase the burning rate, lower the energy of activation, and/or lower the combustion temperature of the encapsulated, particulate energetic composition. The enhanced proximity of the encapsulating combustible fuel to the oxidizer particles may also eliminate the need to add additional combustion catalysts to the encapsulated, particulate energetic composition of the invention.

Likewise, some metals and metal oxides may also act as a combustion catalyst in an explosive, when, for example, ferric oxide or copper chromite, encapsulates explosive particles in an encapsulated, particulate energetic composition of the invention.

Conventional energetic compositions are frequently heterogeneous mixtures of crystalline powders of explosive and/or oxidizer particles in a rubbery binder, such as hydroxyl-terminated polybutadiene (HTPB). In preparing these mixtures, wetting agents are used to increase the wettability of the explosive and/or oxidizer particles to the binder. In an exemplary embodiment of the invention, encapsulating the explosive and/or oxidizer particles with a combustible fuel may provide improved wettability of the encapsulated particles of the energetic composition. It is thought that encapsulation by a combustible fuel, such as, a metal or a metal oxide, modifies the surface properties of the encapsulated particles to increase the surface energy of the encapsulated particles and provide better wettability and adhesion of the binder. This improved wettability may reduce or even eliminate the need for a wetting agent in the making of an encapsulated, particulate energetic composition.

It is known that the addition of binders, bonding agents, and/or wetting agents in the conventional formulation of an energetic composition inhibits the efficient and prompt consumption of a combustible fuel, such as, a combustible metal or metal oxide, upon explosive detonation. The binder, bonding agent, or wetting agent, which has a lower thermal conductivity than the metal or metal oxide, may act as an intervening thermal barrier for heat transfer from the explosive or oxidizer material to the combustible fuel, when used in the formulation of an energetic composition. This thermal barrier may lead to the inefficient combustion of the combustible fuel and a lag in the combustion time frame of the combustible fuel with respect to the explosive detonation. Hence, the reduction or elimination of binders, bonding agents, and/or wetting agents to the energetic composition, as exemplified by embodiments of the invention, may increase energy output, increase performance, improve efficiency.

It is also known that some explosives, for example, RDX, are soluble in binders, such as, HTPB, at elevated temperatures. Thus, reducing or eliminating the amount of binders used in the energetic composition may improve thermal stability by preventing solvation of the encapsulated explosive particles, while maintaining the enhanced proximity of the explosive to the encapsulating combustible fuel in an exemplary embodiment of the invention.

The particles of an explosive and/or an oxidizer in the encapsulated, particulate energetic composition of exemplary embodiments of the invention may result from low-cost manufacturing practices or the purchase of commercially available energetic materials. For example, known particle sizes of explosives or oxidizers may easily be prepared by sieving, recrystallizing, and/or milling processes applied to explosive and/or oxidizer materials. As is known to one of ordinary skill in the art, the known particle sizes resulting from such processes may provide a comparatively homogeneous size distribution about a mean. Alternatively, off-the-shelf explosive and/or oxidizer particles having a known size, may be readily purchased.

In an exemplary embodiment of the invention, specification of a known size of an explosive and/or oxidizer particle with that of a known thickness of the encapsulating combustible fuel may allow greater precision in controlling the energy output, when compared to that of conventional formulations or that of only controlling a thickness of alternating layers of explosive and combustible fuel.

Recent understanding of the process by which initiation occurs in crystalline or polycrystalline explosives that are subject to shear-induced plastic flow from shock or impact, provides additional benefits for encapsulating explosive particles in the making of the energetic composition. Plastic flow in explosive crystals is due to the creation and motion of dislocations; these dislocations distort the explosive particles and this distortion and dislocated motion introduces micro-shear bands. It is these micro-shear bands that are the sites of heating, melting, sudden crystal failure, and chemical reaction initiation. It is expected that by encapsulating explosive particles with another material, i.e., the combustible fuel, that such shear-induced plastic flow may be inhibited, resulting in improved impact and friction insensitivities.

In addition, when the encapsulating combustible fuel comprises a metal, heat dissipation by the metal thickness of the capsule may prevent initiation by hot spots caused by micro-shear bands, and electrostatic discharge may be prevented by shielding the explosive particle within the electrically conductive metal, i.e., a Faraday cage. The enhanced proximity of the encapsulating combustible fuel to the explosive and/or oxidizer particles may raise the melting point and/or decomposition temperature of the encapsulated, particulate energetic composition resulting in improved thermal stability of the composition.

Some explosives and some oxidizers, for example, ammonium nitrate, ammonium dinitramide, and ammonium perchlorate, are hygroscopic. Encapsulating particles of these explosives and/or oxidizers may prevent their absorption, attraction, and retention of water and/or moisture from the air. The encapsulation would also serve to prevent the leaching of energetic materials into the environment. For example, ammonium perchlorate is soluble in water and readily leaches into the environment. Encapsulating an ammonium perchlorate particle with, for example, a combustible metal fuel, would make the ammonium perchlorate much less soluble and make it environmentally friendlier.

It is also expected that specifying a known size of the explosive particles or the oxidizer particles with respect to the encapsulating thickness of the combustible fuel will allow greater optimization of energetic output for specific shapes and sizes of the encapsulated, particulate energetic composition of the invention, when used as either an explosive payload or a propellant.

An exemplary embodiment of the invention provides an encapsulated, particulate energetic composition that includes one of explosive particles of a known size, oxidizer particles of a known size, and a mixture of explosive particles and oxidizer particles, the explosive particles and the oxidizer particles of the mixture being of known sizes, in which each particle of the one of the explosive particles, the oxidizer particles, and the mixture of explosive particles and oxidizer particles, is encapsulated with a known thickness of a combustible fuel.

Another exemplary embodiment of the invention provides that the explosive particles of the encapsulated, particulate energetic composition include any of: 1,3,5-trinitro-1,3,5-triazinane (RDX), 1,3,5,7-tetranitroperhydro-1,3,5,7-tetrazocine (HMX), 2,4,6,8,10,12-hexanitro-2,4,6,8,10,12-hexaazaisowurtzitane (CL-20), 2-methyl-1,3,5-trinitrobenzene (TNT), 2,4,6-trinitrophenyl-N-methlynitramine (Tetryl), 1,3,5-trinitro-2-[2-(2,4,6-trinitrophenyl)ethenyl]benzene 3-nitro-1,2,4-triazol-5-one (NTO), 1,3,3-trinitroazetidine (TNAZ), nitroguanidine (NQ), tetrazine dioxide (TDO), 2,4,6-trinitrobenzene (TNB), 2,4,6-trinitropyridine (TNPy), 2,4,6-trinitropyridine-N-oxide (TNPyOx), 2,6-diazido-4-nitro-pyridine-N-oxide (DazN-PyOX), triaminoguanidinium azotetrazolate (TAGAZ), diamino azobis tetrazine (DAAT), 2,5-diamino-3,6-dinitropyrazine (ANPZ-i), 2,6-diamino-3,5-dinitropyridine-l-oxide (ANPyO), 2,6-diamino-3,5-dinitropyridine (ANPy), 2,6-bis(picrylamino)-3,5-dinitropyridine (PYX), 2,4-dinitroimidazole (DNI), 1,1-diamino-2,2-dinitroethylene (DADNE or FOX-7), 2,6-diamino-3,5-dinitropyrazine (ANPZ), 2,6-diamino-3,5-dinitropyrazine-1-oxide (LLM-105), 1,3-dinnitrato-2,2-bis(nitratomethyl)propane (PETN), 4,10-Dinitro-2,6,8,12-tetraoxa-4,10-diaza-tetracyclododecane (TEX), ammonium dinitramide (AND), 1-amino-2,4,6-trinitrobenzene (MATB), 1,3-diamino-2,4,6-trinitrobenzene (DATB), 1,3 diazido-2-nitrazapropane (DANP), 1,5 diazido-2,4-nitrazapentane (DADZP), 1,7 diazido-2,4,6-trinitrazaheptane (DATH), n-propyl azidoethyl nitramine (Pr NENEA), and 1,3,5-triamino-2,4,6-trinitrobenzene (TATB).

Yet another exemplary embodiment of the invention provides that the oxidizer particles of the encapsulated, particulate energetic composition include any of: potassium nitrate, sodium nitrate, ammonium nitrate, potassium perchlorate, sodium perchlorate, ammonium perchlorate, lithium perchlorate, nitronium perchlorate, ammonium dinitramide, hydrazinium nitroformate, and phosphorus pentoxide.

Yet another exemplary embodiment of the invention provides that the combustible fuel of the encapsulated, particulate energetic composition includes any of: aluminum, copper, iron, tungsten, hafnium, tantalum, magnesium, nickel, sodium, molybdenum, potassium, phosphorous, silicon, boron, aluminum oxide, copper oxide, iron oxide, tungsten oxide, hafnium oxide, tantalum oxide, magnesium oxide, nickel oxide, sodium monoxide, molybdenum oxides, potassium oxide, boron oxides, and silicon oxides.

Yet another exemplary embodiment of the invention provides that the known size of the explosive particles, the known size of the oxidizer particles, and the known sizes of the explosive particles and the oxidizer particles in the mixture ranges from about 0.1 microns diameter to about 1 centimeter diameter.

Yet another exemplary embodiment of the invention provides that the known thickness of a combustible fuel is greater than 1 nanometer.

Yet another exemplary embodiment of the invention further includes any of a binder, a bonding agent, a combustion catalyst, a desensitizer, a plasticizer, and a wetting agent.

Yet another exemplary embodiment of the invention provides an encapsulated, particulate energetic composition including one of: explosive particles of a known size, oxidizer particles of a known size, and a mixture of explosive particles and oxidizer particles, the explosive particles and the oxidizer particles of the mixture being of known sizes, in which each particle of the one of the explosive particles, the oxidizer particles, and the mixture of explosive particles and oxidizer particles, is encapsulated with a known thickness of a combustible metal fuel and/or a combustible metal oxide fuel.

Yet another exemplary embodiment of the invention provides a method of making an encapsulated, particulate energetic composition. The method includes placing one of explosive particles, oxidizer particles, and a mixture of explosive particles and oxidizer particles within a deposition chamber, in which the explosive particles are of a known size, the oxidizer particles are of a known size, and the explosive particles and the oxidizer particles of the mixture are of an known sizes; mixing the one of the explosive particles, the oxidizer particles, and the mixture of explosive particles and oxidizer particles, and depositing, to a known encapsulating thickness, a combustible fuel onto each particle of the one of the explosive particles, the oxidizer particles, and the mixture of explosive particles and oxidizer particles during the mixing.

Yet another exemplary embodiment of the invention provides the method of making the encapsulated, particulate energetic composition, in which the explosive particles include any of: 1,3,5-trinitro-1,3,5-triazinane (RDX), 1,3,5,7-tetranitroperhydro-1,3,5,7-tetrazocine (HMX), 2,4,6,8,10,12-hexanitro-2,4,6,8,10,12-hexaazaisowurtzitane (CL-20), 2-methyl-1,3,5-trinitrobenzene (TNT), 2,4,6-trinitrophenyl-N-methlynitramine (Tetryl), 1,3,5-trinitro-2-[2-(2,4,6-trinitrophenyl)ethenyl]benzene (HNS), 3-nitro-1,2,4-triazol-5-one (NTO), 1,3,3-trinitroazetidine (TNAZ), nitroguanidine (NQ), tetrazine dioxide (TDO), 2,4,6-trinitrobenzene (TNB), 2,4,6-trinitropyridine (TNPy), 2,4,6-trinitropyridine-N-oxide (TNPyOx), 2,6-diazido-4-nitro-pyridine-N-oxide (DazN-PyOX), triaminoguanidinium azotetrazolate (TAGAZ), diamino azobis tetrazine (DAAT), 2,5-diamino-3,6-dinitropyrazine (ANPZ-i), 2,6-diamino-3,5-dinitropyridine-1-oxide (ANPyO), 2,6-diamino-3,5-dinitropyridine (ANPy), 2,6-bis(picrylamino)-3,5-dinitropyridine (PYX), 2,4-dinitroimidazole (DNI), 1,1-diamino-2,2-dinitroethylene (DADNE or FOX-7), 2,6-diamino-3,5-dinitropyrazine (ANPZ), 2,6-diamino-3,5-dinitropyrazine-l-oxide (LLM-105), 1,3-dinnitrato-2,2-bis(nitratomethyl)propane (PETN), 4,10-Dinitro-2,6,8,12-tetraoxa-4,10-diaza-tetracyclododecane (TEX), ammonium dinitramide (AND), 1-amino-2,4,6-trinitrobenzene (MATB), 1,3-diamino-2,4,6-trinitrobenzene (DATB), 1,3 diazido-2-nitrazapropane (DANP), 1,5 diazido-2,4-nitrazapentane (DADZP), 1,7 diazido-2,4,6-trinitrazaheptane (DATH), n-propyl azidoethyl nitramine (Pr NENEA), and 1,3,5-triamino-2,4,6-trinitrobenzene (TATB).

Yet another exemplary embodiment of the invention provides the method of making the encapsulated, particulate energetic composition, in which the oxidizer particles include any of: potassium nitrate, sodium nitrate, ammonium nitrate, potassium perchlorate, sodium perchlorate, ammonium perchlorate, lithium perchlorate, nitronium perchlorate, ammonium dinitramide, hydrazinium nitroformate, and phosphorus pentoxide.

Yet another exemplary embodiment of the invention provides the method of making the encapsulated, particulate energetic composition, in which the combustible fuel includes any of: aluminum, copper, iron, tungsten, hafnium, tantalum, magnesium, nickel, sodium, molybdenum, potassium, phosphorous, silicon, boron, aluminum oxide, copper oxide, iron oxide, tungsten oxide, hafnium oxide, tantalum oxide, magnesium oxide, nickel oxide, sodium monoxide, molybdenum oxides, potassium oxide, boron oxides, and silicon oxides.

Yet another exemplary embodiment of the invention provides the method of making the encapsulated, particulate energetic composition, in which the known size (distribution) of the explosive particles, the known size (distribution) of the oxidizer particles, and the known sizes (distribution) of the explosive particles and the oxidizer particles in the mixture is obtained by one of: commercial purchase; sieving; recrystallizing; and milling.

Yet another exemplary embodiment of the invention provides the method of making the encapsulated, particulate energetic composition, in which the known size of the explosive particles, the known size of the oxidizer particles, and the known sizes of the explosive particles and the oxidizer particles in the mixture ranges from about 0.1 microns diameter to about 1 centimeter diameter.

Yet another exemplary embodiment of the invention provides that the method of making the encapsulated, particulate energetic composition further includes locating a sample of the one of the explosive particles, the oxidizer particles, and the mixtures of explosive particles and the oxidizer particles, relative to a source of the combustible fuel within the deposition chamber.

Yet another exemplary embodiment of the invention provides the method of making the encapsulated, particulate energetic composition, in which the mixing includes any of rotating a sample cup, containing the sample, from a range of 0 to 20 rotations per minute, introducing a stirrer into the sample, vibrating the sample, and introducing relatively large inert particles into a rotating sample cup.

Yet another exemplary embodiment of the invention provides the method of making the encapsulated, particulate energetic composition, in which the locating of the sample includes fixing a sample cup at a position and angle relative to a combustible fuel target in the deposition chamber by empirically adjusting the position and angle of the sample cup and the position and angle of the combustible target to obtain a maximal deposition rate of the combustible fuel onto the one of the explosive particles, the oxidizer particles, and the mixture of explosive particles and oxidizer particles.

Yet another exemplary embodiment of the invention provides the method of making the encapsulated, particulate energetic composition, in which the known encapsulating thickness of a combustible fuel is greater than 1 nanometer.

Yet another exemplary embodiment of the invention provides the method of making the encapsulated, particulate energetic composition, in which the known encapsulating thickness is verified by any of a quartz crystal microbalance X-ray photoelectron spectroscopy.

Yet another exemplary embodiment of the invention provides the method of making the encapsulated, particulate energetic composition, in which the deposition chamber is a sputtering chamber that maintains a vacuum into which an inert gas is introduced.

BRIEF DESCRIPTION OF THE DRAWINGS

Exemplary embodiments of the present invention are discussed herein in reference to the drawings, in which.

DETAILED DESCRIPTION OF EMBODIMENTS OF THE INVENTION

Figure 1:
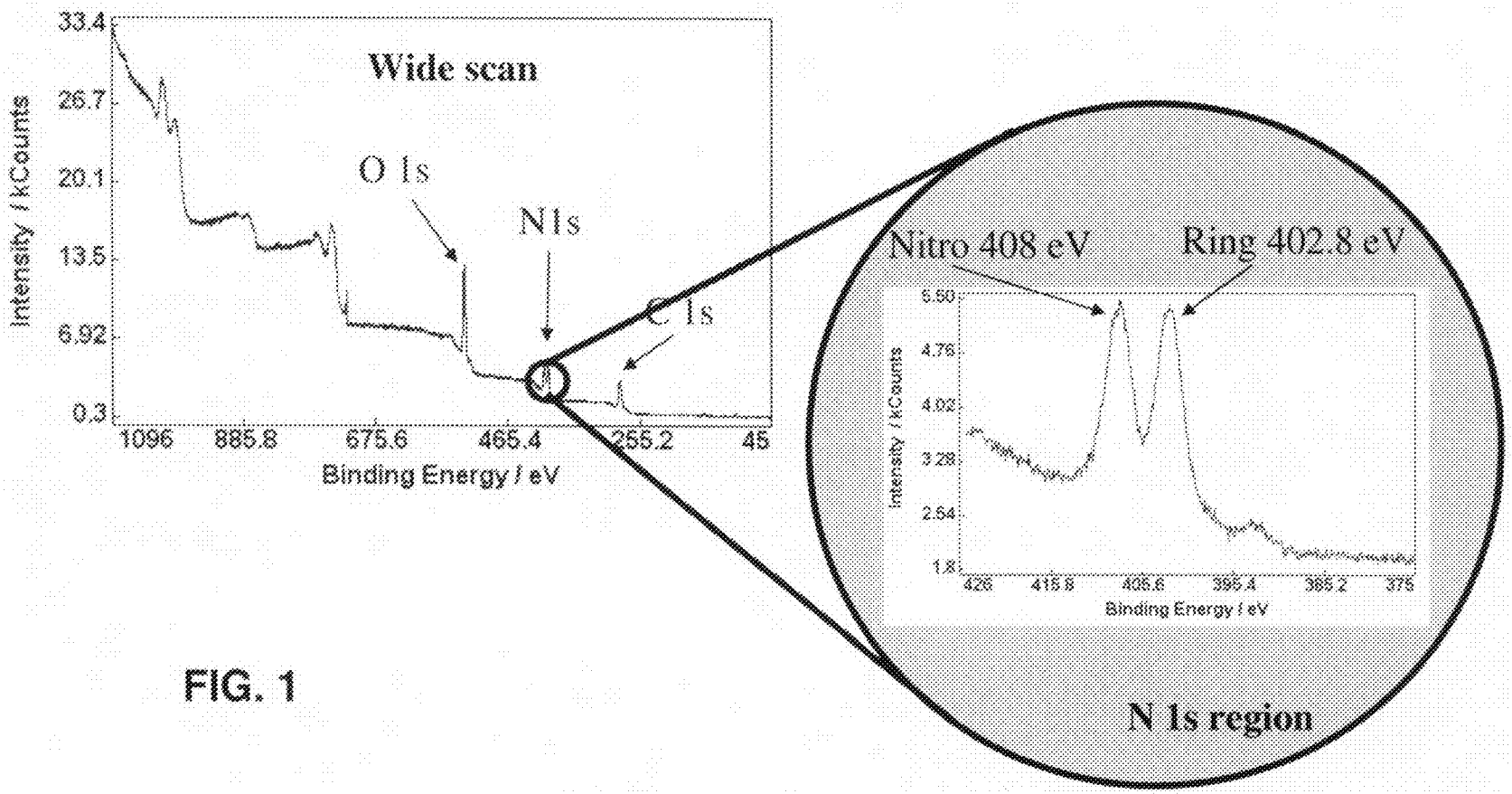
FIG. 1 illustrates a wide-scan X-ray photoelectron spectrum of 1,3,5-trinitro-1,3,5-triazinane (RDX) explosive particles for the C 1s, N 1s, O 1s regions of RDX explosive particles, and a detailed view of the N 1s region, which identified changes to the chemical state of the RDX as relates to the nitro group and the ring structure, in an exemplary embodiment of the present invention.

An exemplary embodiment of the encapsulated, particulate energetic composition of the present invention may include explosive particles of a known size, oxidizer particles of a known size, and/or a mixture of explosive and oxidizer particles of known sizes, each of the explosive and/or oxidizer particles being encapsulated by a combustible fuel of a known thickness.

The explosive particles may include any of nitramines, sometimes referred to as nitroamines, for example, 1,3,5-trinitro-1,3,5-triazinane (RDX), 1,3,5,7-tetranitroperhydro-1,3,5,7-tetrazocine (HMX), 2,4,6,8,10,12-hexanitro-2,4,6,8,10,12-hexaazaisowurtzitane (CL-20), and other energetic compounds, for example, 2-methyl-1,3,5-trinitrobenzene (TNT), 2,4,6-trinitrophenyl-N-methlynitramine (Tetryl), 1,3,5-trinitro-2-[2-(2,4,6-trinitrophenyl)ethenyl]benzene (HNS), 3-nitro-1,2,4-triazol-5-one (NTO), 1,3,3-trinitroazetidine (TNAZ), nitroguanidine (NQ), tetrazine dioxide (TDO), 2,4,6-trinitrobenzene (TNB), 2,4,6-trinitropyridine (TNPy), 2,4,6-trinitropyridine-N-oxide (TNPyOx), 2,6-diazido-4-nitro-pyridine-N-oxide (DazN-PyOX), triaminoguanidinium azotetrazolate (TAGAZ), diamino azobis tetrazine (DAAT), 2,5-diamino-3,6-dinitropyrazine (ANPZ-i), 2,6-diamino-3,5-dinitropyridine-l-oxide (ANPyO), 2,6-diamino-3,5-dinitropyridine (ANPy), 2,6-bis(picrylamino)-3,5-dinitropyridine (PYX), 2,4-dinitroimidazole (DNI), 1,1-diamino-2,2-dinitroethylene (DADNE or FOX-7), 2,6-diamino-3,5-dinitropyrazine (ANPZ), 2,6-diamino-3,5-dinitropyrazine-1-oxide (LLM-105), 1,3-dinnitrato-2,2-bis(nitratomethyl)propane (PETN), 4,10-Dinitro-2,6,8,12-tetraoxa-4,10-diaza-tetracyclododecane (TEX), ammonium dinitramide (AND), 1-amino-2,4,6-trinitrobenzene (MATB), 1,3-diamino-2,4,6-trinitrobenzene (DATB), 1,3 diazido-2-nitrazapropane (DANP), 1,5 diazido-2,4-nitrazapentane (DADZP), 1,7 diazido-2,4,6-trinitrazaheptane (DATH), n-propyl azidoethyl nitramine (Pr NENEA) and 1,3,5-triamino-2,4,6-trinitrobenzene (TATB) in an exemplary embodiment of the invention. In an exemplary embodiment of the invention, the explosive particles may comprise a crystal of an explosive material or a polycrystalline structure of the explosive material.

In an exemplary embodiment of the invention, the oxidizer particles may include any of potassium nitrate, sodium nitrate, ammonium nitrate, potassium perchlorate, sodium perchlorate, ammonium perchlorate, lithium perchlorate, nitronium perchlorate, ammonium dinitramide, hydrazinium nitroformate, and phosphorus pentoxide. In an exemplary embodiment of the invention, the oxidizer particle may comprise a crystal of an oxidizer material or a polycrystalline structure. In an exemplary embodiment of the invention, the oxidizer particles may include a crystal of an oxidizer material or a polycrystalline structure of the oxidizer material.

In an exemplary embodiment of the invention, an encapsulating thickness of combustible fuel may include a combustible metal, for example, any of aluminum, copper, iron, tungsten, hafnium, tantalum, magnesium, nickel, sodium, molybdenum, and potassium, or a non-metal, for example, any of phosphorous, silicon, and boron. The combustible fuel may also include a metal oxide, for example, any of aluminum oxide, copper oxide, iron oxide, tungsten oxide, hafnium oxide, tantalum oxide, magnesium oxide, nickel oxide, sodium monoxide, molybdenum oxides, and potassium oxide, or a non-metal oxide, for example, any of boron oxides and silicon oxides.

Experimental (Actual) Methodology:

The RDX explosive crystals of a known size, i.e., 150 to 300 microns diameter, were commercially obtained from BAE Systems, Ordnance Systems Inc., Holston Army Ammunition Plant, Kingsport Tenn. Alternatively, a known size of explosive particles may be obtained by sieving, recrystallization, and/or milling explosive particles to obtain a known size of explosive particles.

Similarly, oxidizer particles of a known size (distribution) may be obtained commercially or may be sieved, recrystallized, and/or milled to obtain a known size of oxidizer particles.

Sputtering of aluminum onto RDX crystals was accomplished in an ultra high vacuum (UHV) apparatus. Sputtering is a physical vapor deposition technique used to deposit thin films of a material onto an RDX crystal. A gaseous plasma of argon gas was created in the sputtering chamber and the plasma ions were accelerated onto a target material of aluminum. The target material was eroded by the arriving plasma ions, via energy transfer, and was ejected in the form of neutral particles, that is, individual aluminum atoms or clusters of aluminum atoms. An energy source, for example, RF, DC, or microwave, was used to initiate and maintain the plasma state. This dynamic condition was created by metering argon gas into a pre-pumped vacuum chamber and allowing the chamber pressure to reach a specific level, for example, 0.01 Torr, and by introducing a live electrode into this low pressure gas environment using a vacuum feedthrough.

To overcome the two main problems of conventional sputtering, that is, overheating and structural damage to the target by electron bombardment, and a slow deposition rate, the inventor also used the technique of magnetron sputtering. Magnetron sputtering uses magnets behind the target to create strong electric and magnetic fields. These fields trap electrons directly above the target surface, where they are less likely to bombard the target. Instead, the electrons follow helical paths around the magnetic field lines, providing more ionizing collisions with neutral gaseous particles, for example, argon, near the target surface than would otherwise occur. The extra argon ions created as a result of these collisions lead to a higher deposition rate of the target atoms.

Magnetron sputtering has proven extremely beneficial in the semiconductor industry for the deposition of two dimensional thin films. In an exemplary embodiment of the invention, encapsulation of the particle surfaces of the explosive material, RDX, with aluminum was accomplished by the mixing and/or agitation of the RDX explosive particles within the magnetron sputtering chamber. As is known to one of ordinary skill in the art, the degree of encapsulation of each individual RDX particle varies with inter alia the deposition rate of the aluminum, the exposure time of individual surfaces of the RDX particles to the deposited aluminum, the amount of mixing, and the time of aluminum deposition. Effective encapsulation of the RDX particles by magnetron sputtering was determined by microscopic visualization of the encapsulated RDX particles, which showed a homogeneous metallic encapsulation of the RDX particles.

Figure 3:
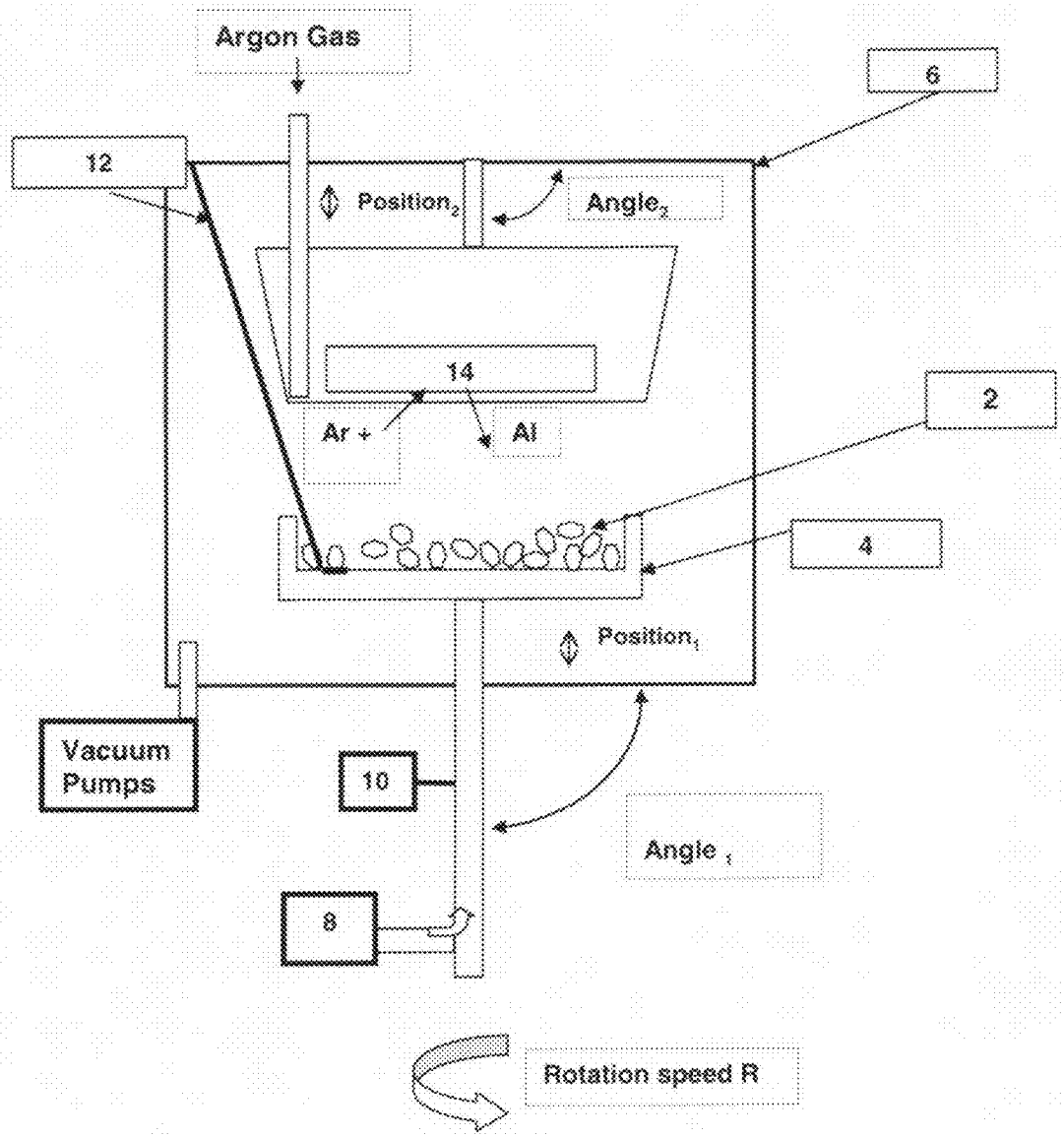
FIG. 3 illustrates a schematic diagram of a sputtering system used for the physical deposition of an encapsulating combustible fuel on explosive and/or oxidizer particles of an encapsulated, particulate energetic composition in an exemplary embodiment of the present invention.

Referring to FIG. 3, sample particles 2, that is, RDX explosive particles of 150-300 microns diameter were effectively encapsulated by magnetron sputtering of an aluminum target when the RDX explosive particles were rotated within a sample cup 4 of a magnetron sputtering chamber 6. The sample cup 4, containing the RDX explosive articles 2, was positioned at an angle with respect to the gravitational force in an exemplary embodiment of the invention. The RDX explosive particles 2 were rotated in the sample cup at a rate of approximately or about 0-20 rotations per minute in an exemplary embodiment of the invention. In various exemplary embodiments, the sample cup 4 may also be cooled 8, for example, through the use of air, gas, liquid nitrogen, or water. In an exemplary embodiment of the invention, an effective angle ($Angle_1$) and rotation rate (R) were empirically selected to cause the RDX explosive particles to slip or fall within the rotating sample cup 4, to create the desired mixing of the RDX explosive particles. In various exemplary embodiments of the invention, mixing of the explosive particles may be enhanced by vibrating via a vibration mechanism 12 the rotating sample cup 4 or by introduction of a stirrer 12, while the sample cup is rotating. The stirrer may, for example, be attached to a linear feedthrough of the magnetron sputtering chamber, which allows for the adjustment in its position with respect to the sample cup. Additionally, the introduction of inert materials, which were of a larger size than the RDX explosive particles and which could tumble inside the rotating sample cup, was also found useful in enhancing the mixing of the RDX explosive particles in an exemplary embodiment of the invention. Alternatively, other particulate mixing processes well known to those in the art may be used.

Similarly, in various exemplary embodiments of the invention, oxidizer particles of a known size (distribution) or a mixture of explosive and oxidizer particles of known sizes (distribution) may be encapsulated by a combustible fuel to a known thickness by magnetron sputtering, when the oxidizer particles or the mixture of explosive and oxidizer particles is rotated within the sample cup of the magnetron sputtering chamber. In addition, the sample cup containing the oxidizer particles or a mixture of explosive and oxidizer particles may be positioned at a known angle with respect to the gravitational force, rotated at a known rate of rotation, and/or cooled in various exemplary embodiments of the invention. Likewise, mixing of the oxidizer particles or a mixture of explosive and oxidizer particles, contained in the sample cup, may be enhanced by vibrating the rotating sample cup, introducing a stirrer while the sample cup is rotating, or introducing large inert particles, which may tumble inside the rotating sample cup. Alternatively, other particulate mixing processes well known to those in the art may be used.

Experimentally, the positioning of the sample cup, containing the RDX explosive particles, relative to the aluminum target 14 was found to affect, greatly, the deposition rate of the aluminum onto the RDX explosive particles. In the present experiment, the height ($Position_1$) and angle ($Angle_1$) of the sample cup, containing the RDX explosive particles, and the position ($Position_2$) and angle ($Angle_2$) of the aluminum target could be adjusted with respect to the magnetron sputtering chamber. In various exemplary embodiments, empirically adjusting the positions and angles of the combustible fuel target and the sample cup, containing explosive particles, oxidizer particles, and/or a mixture of explosive and oxidizer particles, may be used to adjust deposition rates of the combustible fuel material on the explosive particles, oxidizer particles, or a mixture of explosive and oxidizer particles.

Experimental (Actual) Analysis:

The experimental analysis of the aluminum encapsulated RDX crystals was performed in a stainless steel UHV chamber with a working base pressure of $1\times10^{-10}$ Torr. The UHV chamber contained, among other things, a hemispherical analyzer used in concert with a dual Al/Mg $K_\alpha$ X-ray source for X-ray photoelectron spectroscopy (XPS), and a quadrupole mass spectrometer for residual gas analysis. The thickness of the deposited aluminum was verified by a quartz crystal microbalance and XPS data. The aluminum thickness ranged from about 1 to about 10,000 nm. The RDX crystals were mounted onto a grounded translation stage with double-sided conductive tape to minimize electrical charging.

Figure 2:
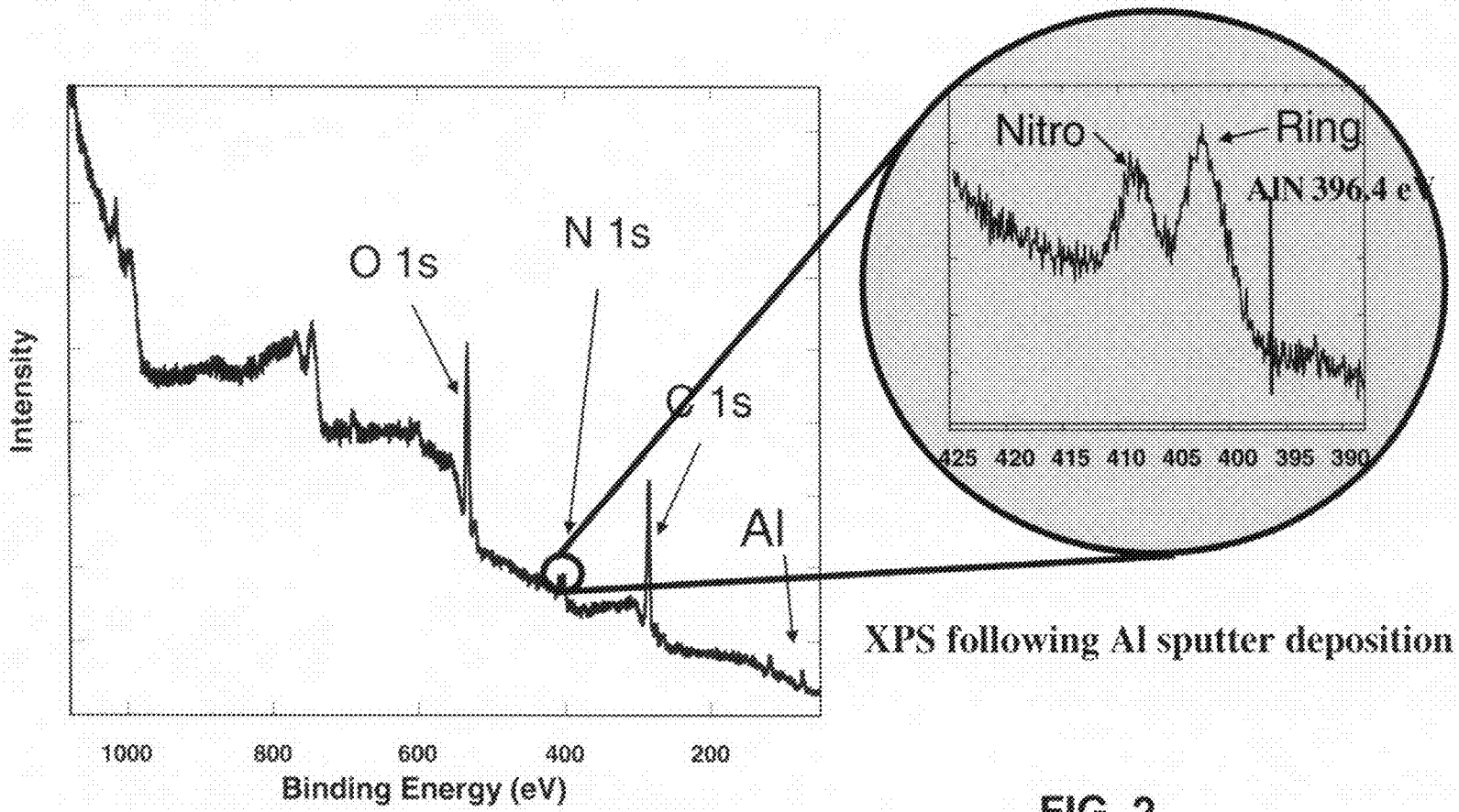
FIG. 2 illustrates a wide-scan X-ray photoelectron spectrum of RDX explosive particles following aluminum sputter deposition, in which the nitrogen peak associated with the nitro group was diminished compared to that of the ring structure, indicating a preferential reaction of the nitro group of the RDX to the aluminum deposition, while leaving the ring structure intact structure, in an exemplary embodiment of the present invention.

FIG. 1 shows an N 1s X-ray photoelectron spectrum of RDX crystals, while FIG. 2 shows the N 1s X-ray photoelectron spectrum of the RDX crystals following encapsulation with aluminum of less than 1 nm thickness. Following encapsulation with aluminum, the N 1s spectrum reveals that the nitrogen peak associated with the nitro group is diminished compared to that of the ring structure. This difference is an indication of the preferential reaction of the nitro group of the RDX crystals to the aluminum encapsulation, which leaves the ring structure intact. With increasing thickness of the aluminum encapsulation, the signal associated with the nitro group is diminished further with little change observed in the N 1s intensity of the ring structure.

Experimental results produced aluminum encapsulated RDX crystalline explosive particles of 150-300 microns diameter, each crystal being encapsulated by an aluminum metal thickness of approximately or about 100 nm. Microscopic visualization of the particle-like nature of the encapsulated RDX particles demonstrated that the underlying RDX particles remained intact and were not damaged during encapsulation; the shiny metallic surface of the encapsulated RDX particles was also indicative of a homogenous coating.

Figure 4:
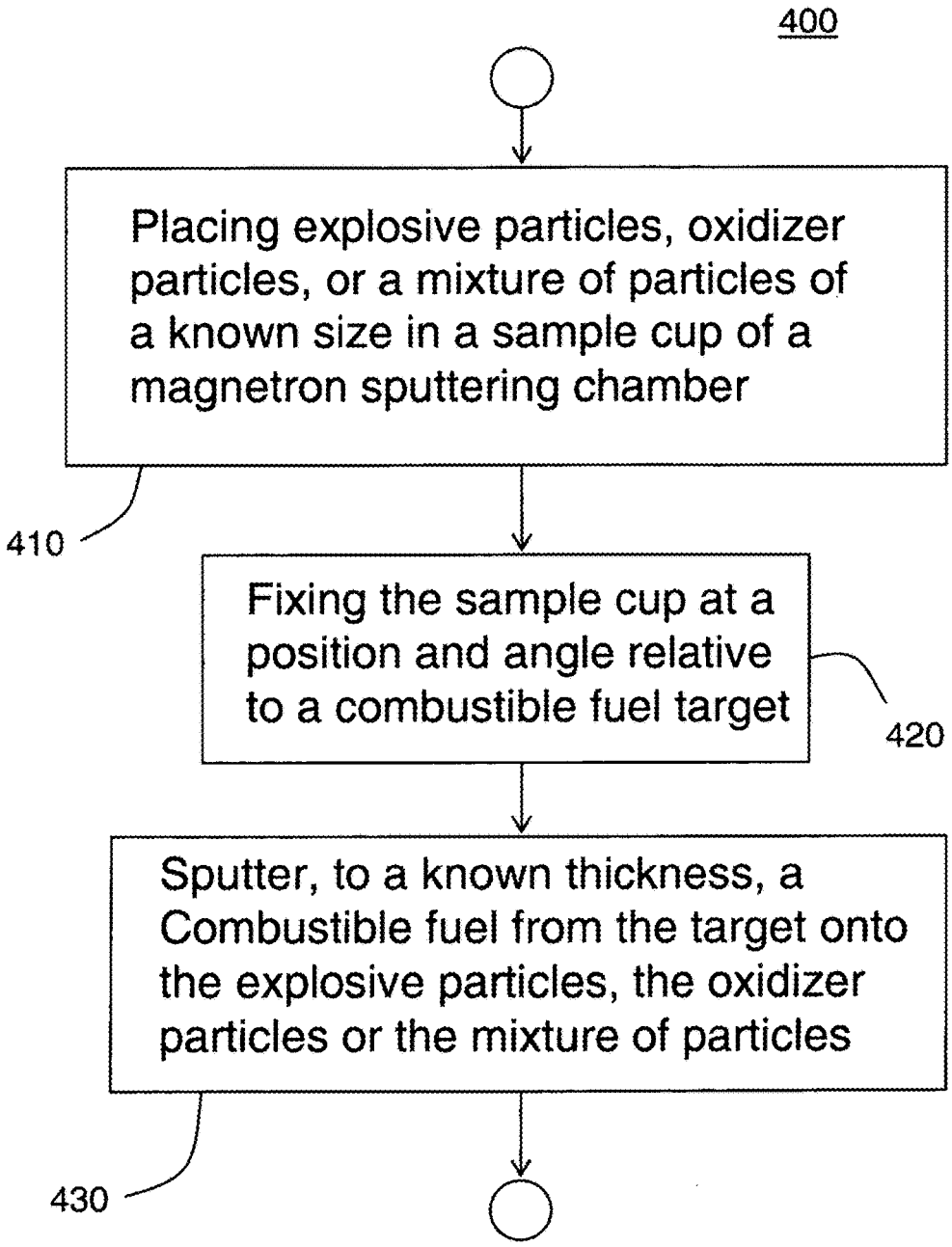
FIG. 4 illustrates a flow diagram of a method of making an encapsulated, particulate energetic composition in an exemplary embodiment of the present invention.

Method of Making:

Referring to FIG. 4, in various exemplary embodiments of the invention, a method of making an encapsulated, particulate energetic composition 400 may include placing one of explosive particles of a known size, oxidizer particles of a known size, and a mixture of explosive particles and oxidizer particles of known sizes within a sample cup located in a magnetron sputtering chamber 410, fixing the sample cup at a position and angle relative to a combustible fuel target in the magnetron sputtering chamber 420, and sputtering, to a known encapsulating thickness, a combustible fuel from the combustible fuel target onto one of explosive particles of a known size (distribution), oxidizer particles of a known size (distribution), and a mixture of explosive particles and oxidizer particles of known sizes in the sample cup 430.

Because many varying and different exemplary embodiments may be made with the scope of the inventive concepts taught herein, and because many modifications may be made in the exemplary embodiments detailed herein in accordance with the descriptive requirements of the law, it is to be understood that the detailed descriptions herein are to be interpreted as illustrative and not in a limiting sense.

Finally, any numerical parameters set forth in the specification and attached claims are approximations (for example, by using the term "about" or "approximately") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed:

1. An encapsulated, particulate energetic composition, consisting of:

one of explosive particles of a known size, oxidizer particles of a known size, and a mixture of explosive particles and oxidizer particles, wherein said one of said explosive particles each comprises a particle surface, wherein said explosive particles and said oxidizer particles of said mixture are of known sizes, wherein particles of said one of said explosive particles, said oxidizer particles and said mixture of explosive particles and oxidizer particles, are encapsulated by a known thickness of a combustible fuel, wherein a thin film of the combustible fuel is bonded to said particle surface through a reaction to encapsulate said one of said explosive particles, said oxidizer particles and said mixture of explosive particles and oxidizer particles where the thin film is immediately adjacent the particle surface, which is encapsulated, and wherein said know thickness of the thin film is directly deposited and directly bonded to the particle surface absent an intermediate layer between the thin film and the particle surface using a sputtering process in order to form the encapsulated, particulate energy composition, and wherein the combustible fuel is one of a combustible metal and a combustible metal oxide.

2. The encapsulated, particulate energetic composition of claim 1, wherein said explosive particles comprise any of 1,3,5-trinitro-1,3,5-triazinan (RDX), 1,3,5,7-tetranitroperhydro-1,3,5, 7-tetrazocine (HMX), 2,4,6,8,10,12-hexanitro 2,4,6,8,10,12-hexaazaisowurtzitane (CL-20), 2-methyl-1,3, 5-trinitrobenzene (TNT), 2,4,6-trinitrophenyl-N-methlynitramine (Tetryl), 1,3,5-trinitro-2-[2-(2,4,6-trinitrophenyl) ethenyl]benzene (HNS), 3-nitro-1,2, triazol-5-one (NTO), 1,3,3-trinitroazetidine (TNAZ), nitroguanidine (NQ), tetrazine dioxide (TDO), 2,4,6-trinitrobenzene (TNB), 2,4,6-trinitropyridine (TNPy), 2,4,6-trinitropyridine-N-oxide (TNPyOx) 2,6-diazido-4-nitro-pyridine-N-oxide (DazNPyOX), triaminoguanidinium azotetrazolate (TAGAZ), diamino azobis tetrazine (DAAT), 2,5-diamino-3,6-dinitropyrazine (ANPZ-i), 2,6-diamino-3,5-dinitropyridine-1-oxide (ANPyO), 2,6-diamino-3,5-dinitropyridine (ANPy), 2,6-bis(picrylamino)-3,5 dinitropyridine (PYX), 2,4-dinitroimidazole (DNI), 1,1-diamino-2,2-dinitroethylene (DADNE or FOX-2,6-diamino-3,5-dinitropyrazine (ANPZ), 2,6-diamino-3,5-dinitropyrazine-1-oxide (LLM-105), 1,3-dinnitrato-2,2-bis(nitratomethyl)propane (PETN), 4,1O-Dinitro-2,6,8,12-tetraoxa-4, 10-diaza-tetracyclododecane (TEX), ammonium dinitramide (AND), 1-amino-2,4, 6-trinitrobenzene (MATB), 1,3-diamino-2,4,6-trinitrobenzene (DATB), 1,3 diazido-2-nitrazapropane (DANP), 1,5 diazido-2,4-nitrazapentane (DADZP), 1,7 diazido-2,4,6-trinitrazaheptane (DATH), n-propyl azidoethyl nitramine (Pr NENEA), and 1,3,5 triamino-2,4,6-trinitrobenzene (TATB).

3. The encapsulated, particulate energetic composition of claim 1, wherein said oxidizer particles comprise any of potassium nitrate, sodium nitrate, ammonium nitrate, potassium perchlorate, sodium perchlorate, ammonium perchlorate, lithium perchlorate, nitronium perchlorate, ammonium dinitramide, hydrazinium nitroformate, and phosphorus pentoxide.

4. The encapsulated, particulate energetic composition of claim 1, wherein said combustible fuel comprises any of aluminum, copper, iron, tungsten, hafnium, tantalum, magnesium, nickel, sodium, molybdenum, potassium, phosphorous, silicon, boron, aluminum oxide, copper oxide, iron oxide, tungsten hafnium oxide, tantalum oxide, magnesium oxide, nickel oxide, sodium monoxide, molybdenum oxides, potassium oxide, boron oxides, and silicon oxides.

5. The encapsulated, particulate energetic composition of claim 1, wherein said known size of said explosive particles, said known size of said oxidizer particles, and said known sizes of said explosive particles and said oxidizer particles in said mixture ranges from 0.1 microns diameter to 1 centimeter diameter.

6. The encapsulated, particulate energetic composition of claim 1, wherein said known thickness of a combustible fuel is greater than 1 nanometer.

7. The encapsulated, particulate energetic composition of claim 1, further comprising any of a combustion catalyst, a desensitizer, a plasticizer, and a wetting agent.

8. An encapsulated, particulate energetic composition, consisting of:

one of explosive particles of a known size, oxidizer particles of a known size, d a mixture of explosive particles and oxidizer particles, wherein said one of said explosive particles and said oxidizer particles being of known sizes, wherein particles of said one of explosive particles, said oxidizer particles, said mixture of explosive particles and oxidizer particles, are and encapsulated a by known thickness of one of a combustible metal oxide fuel, and a combustible metal fuel and the combustible metal oxide fuel, wherein a thin film of said one of said combustible metal oxide fuel, an said combustible metal fuel and said combustible metal oxide fuel, is bonded to said particle surface through a reaction to encapsulate said one of said explosive particles, said oxidizer particles and said mixture of explosive particles and oxidizer particles where the thin film is immediately adjacent the particle surface, which is encapsulated, and said known thickness of the thin film is formed from a continuous sputtering deposition process, wherein said known thickness of the thin film is directly deposited and directly bonded to the particle surface using a continuous sputtering deposition process absent an intermediate layer between the thin film and the particle surface in order to form the encapsulated, particulate energy composition.

9. The encapsulated, particulate energetic composition of claim 1, wherein the encapsulated, particulate energetic composition includes the explosive particle comprised of RDX crystals and the combustible fuel comprised of aluminum, wherein a bond exists between a nitro group of the RDX crystals and the aluminum, and wherein a N 1s x-ray photoelectron spectrum of the bond includes the nitro group peak of the RDX crystal is diminished in intensity relative to a ring structure peak of the RDX crystal.

* * * * *